US008082084B2

(12) United States Patent
Nichols

(10) Patent No.: US 8,082,084 B2
(45) **Date of Patent: *Dec. 20, 2011**

(54) LOADER AND LOADER CONTROL SYSTEM

(75) Inventor: Mark Nichols, Christchurch (NZ)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/977,730

(22) Filed: Dec. 23, 2010

(65) Prior Publication Data

US 2011/0091308 A1 Apr. 21, 2011

Related U.S. Application Data

(63) Continuation of application No. 11/959,722, filed on Dec. 19, 2007, now Pat. No. 7,881,845.

(51) Int. Cl.
*G01S 5/02* (2010.01)
*E02F 9/26* (2006.01)
*G01C 21/00* (2006.01)

(52) U.S. Cl. ..... 701/50; 701/213; 414/722; 37/438

(58) Field of Classification Search ..... 701/50, 701/213, 36; 414/722, 685; 172/430; 340/995.1
See application file for complete search history.

(56) References Cited

U.S. PATENT DOCUMENTS 4,129,224 A 12/1978 Teach (Continued)

FOREIGN PATENT DOCUMENTS

CN 2844231 Y 12/2006

OTHER PUBLICATIONS

International Search Report and Written Opinion pertaining to International application No. PCT/US2007/072997 dated Dec. 5, 2008.

(Continued)

*Primary Examiner* — Tan Q Nguyen
(74) *Attorney, Agent, or Firm* — Dinsmore & Shohl, LLP

(57) ABSTRACT

A loader and a control system for a loader provide for monitoring the position of a part of the implement carried by the loader. The loader has a body with left and right upright tower portions, and a loader drive system including ground engaging drive elements. Left and right interconnected lift arm assemblies each have an implement lift arm pivotally connected with a corresponding tower portion of the body at a lift arm pivot point. A lift actuator is connected between the body and the lift arm. The implement is pivotally connected with the lift arm assemblies about an implement pivot axis. The lift arm pivot point and the implement pivot axis in side elevation define a straight reference line. At least one implement tilt actuator is connected between at least one of the lift arm assemblies and the implement. A position sensor is mounted on the body at the level of, or above, the lift arm pivot points. An inclinometer is movable with the left and right interconnected lift arm assemblies to provide an indication of the inclination of the lift arm assemblies along the straight reference line. An angle sensor provides an indication of the orientation of said implement with respect to said left and right interconnected lift arm assemblies. The control is responsive to the position sensor, the inclinometer, and the angle sensor. The control determines the position of the position sensor and the position of a part of the implement with respect to the position sensor.

18 Claims, 5 Drawing Sheets

U.S. PATENT DOCUMENTS

| | | | | |
|---|---|---|---|---|
| 5,854,988 | A | 12/1998 | Davidson et al. | |
| 5,964,298 | A | 10/1999 | Greenspun | |
| D419,568 | S | 1/2000 | Baig et al. | |
| 6,076,029 | A | 6/2000 | Watanabe et al. | |
| 6,109,858 | A | 8/2000 | Deneve et al. | |
| 6,171,050 | B1 | 1/2001 | Johnson | |
| 6,249,939 | B1 | 6/2001 | Kremer | |
| 6,253,160 | B1 | 6/2001 | Hanseder | |
| 6,263,595 | B1 * | 7/2001 | Ake | 37/348 |
| 6,470,251 | B1 | 10/2002 | Enix | |
| 6,618,659 | B1 | 9/2003 | Berger et al. | |
| 6,837,319 | B2 | 1/2005 | Dvorak et al. | |
| 7,059,422 | B2 * | 6/2006 | Burgin | 172/776 |
| 7,079,931 | B2 * | 7/2006 | Sahm et al. | 701/50 |
| 2006/0201007 | A1 | 9/2006 | Piekutowski | |

OTHER PUBLICATIONS

Chinese Office Action dated Jul. 22, 2011 pertaining to Chinese Patent Application No. 200880124015.6.

* cited by examiner

LOADER AND LOADER CONTROL SYSTEM

CROSS-REFERENCE TO RELATED APPLICATIONS

This is a continuation of U.S. patent application Ser. No. 11/959,722 filed Dec. 19, 2007 now U.S. Pat. No. 7,881,845.

STATEMENT REGARDING FEDERALLY SPONSORED RESEARCH OR DEVELOPMENT

Not applicable.

BACKGROUND OF THE INVENTION

This invention relates to a loader, such as a skid steer loader or a multi-terrain loader, and, more particularly, to a control arrangement for such a loader. Loaders of various types are well known in the art, and typically have a body and ground engaging drive elements supporting the body. The drive elements may be either front and rear pairs of driven wheels, or left and driven right endless tracks. Typically, such a loader has left and right interconnected lift arm assemblies that are pivotally mounted to respective tower portions of the body near the rear of the loader, and an implement, such as for example, a bucket, that is pivotally attached at the forward ends of the lift arms. Hydraulic lift actuators or the like are connected between the body and the lift arm assemblies to raise and lower the lift arms. One or more hydraulic actuators are also connected between the lift arm assemblies and the implement to tilt the implement relative to the lift arms during operation of the loader.

Loaders of this type have a great many uses, and they typically have a wide variety of implements that can be readily interchanged. Examples of such implements include dirt buckets, utility buckets, multi-purpose buckets, pallet forks, utility grapple buckets, light material buckets, utility forks, industrial grapple buckets, industrial grapple forks, angle blades, augers, brooms, cold planers, hydraulic hammers, landscape rakes, landscape tillers, material handling arms, stump grinders, trenchers, and vibratory compactors. Dirt buckets and other implements may be used for excavating material, and also for grading, both in a forward direction and in a reverse direction by back blading. Traditional guidance and automated blade control systems of the type used with graders and bulldozers typically include position sensors directly mounted on the machine blades. This is not practical with a loader because of the wide range of movement of the implements, and because of the typical frequent changing of the implements on the loader.

Nevertheless, it is highly desirable to be able to provide control for a loader implement, either by displaying for the operator the position of the implement with respect to the desired height of the implement, or by automated control of the implement.

SUMMARY OF THE INVENTION

This need is met by a loader, such as a skid steer loader or a multi-terrain loader, constructed according to the present invention. The loader includes a body having left and right upright tower portions, a loader drive system including ground engaging drive elements, and left and right interconnected lift arm assemblies. Each left and right interconnected lift arm assembly has an implement lift arm pivotally connected with a corresponding tower portion of the body at a lift arm pivot point, and a lift actuator connected between the body and the lift arm. The loader further includes an implement pivotally connected with the lift arm assemblies about an implement pivot axis. The lift arm pivot point and the implement pivot axis in side elevation define a straight reference line. At least one implement tilt actuator is connected between at least one of the lift arm assemblies and the implement. A position sensor is mounted on the body in fixed relation to the lift arm pivot points. An inclinometer is movable with the left and right interconnected lift arm assemblies to provide an indication of the inclination of the lift arm assemblies along the straight reference line. An angle sensor is mounted on the lift arm assemblies and provides an indication of the orientation of the implement with respect to the left and right interconnected lift arm assemblies. A control is responsive to the position sensor, to the inclinometer, and to the angle sensor, for determining the position of the position sensor and the position of a part of the implement with respect to the position sensor.

The loader may be a multi-terrain loader, in which case the ground engaging drive elements comprise a pair of driven tracks. Alternatively, the loader may be a skid steer loader, in which case the ground engaging drive elements comprise a plurality of driven wheels.

The angle sensor may comprise an inclinometer adjacent the implement pivot axis. Alternatively, the tilt actuator may comprise an hydraulic cylinder, and the angle sensor may comprise an hydraulic cylinder extension sensor.

The position sensor may comprise a total station target, and a receiver responsive to a total station which tracks the position of the total station target. Alternatively, the position sensor may comprise a GNSS antenna and receiver. Alternatively, the position sensor may comprise a laser receiver that is responsive to a beam of laser light swept through a reference plane. Alternatively, the position sensor may comprise a laser receiver, responsive to a pair of canted fan shaped beams of laser light which are rotated about a generally vertical axis, and swept across the laser receiver.

The implement may comprise a bucket, and the part of the implement may comprise the teeth of the bucket. Alternatively, the implement may comprise forks, a cold planer, a trencher, an auger, a vibratory compactor, a drag box, or a blade.

A control system for a loader of the type having a body, a loader drive system including ground engaging drive elements supporting the body, left and right interconnected lift arm assemblies, each assembly including an implement lift arm pivotally connected with the body at a lift arm pivot point, and a lift actuator connected between the body and the lift arm, an implement pivotally connected with the lift arm assemblies for movement about an implement pivot axis, the lift arm pivot point and the implement pivot axis in side elevation defining a straight reference line, at least one implement tilt actuator connected between at least one of the lift arm assemblies and the implement. The control system further includes a position sensor mounted on the body in fixed relation to the lift arm pivot points. An inclinometer is movable with the left and right interconnected lift arm assemblies to provide an indication of the inclination of the lift arm assemblies along the straight reference line. An angle sensor provides an indication of the orientation of the implement with respect to the left and right interconnected lift arm assemblies. A control is responsive to the position sensor, to the inclinometer, and to the angle sensor. The control determines the position of the position sensor and the position of a part of the implement with respect to the position sensor. The implement may comprise a bucket, with the part of the implement comprising the teeth of the bucket.

The control system further comprises a display for displaying the position of a part of the implement to the operator of the loader. Additionally, the control system includes a display for displaying the desired position of the surface of the worksite, whereby the operator may observe the amount of cut or fill required to achieve the desired worksite contour.

The angle sensor may comprise an inclinometer associated with the implement. Alternatively, the tilt actuator may comprise an hydraulic cylinder, and the angle sensor may comprise an hydraulic cylinder extension sensor.

The position sensor may comprise a laser receiver, responsive to a beam of laser light which is swept through a reference plane. Alternatively, the position sensor may comprise a laser receiver, responsive to one or to a pair of canted fan shaped beams of laser light which are rotated about a generally vertical axis, and swept across the laser receiver. Alternatively, the position sensor may comprise a total station target, and a receiver responsive to a total station which tracks the position of the total station target. Alternatively, the position sensor may comprise a GNSS antenna and receiver. Still further, alternatively, the position sensor may be a receiver for a ground based radio positioning system, which may optionally be combined with a GPS receiver or laser receiver.

Accordingly, it is an object of the present invention to provide a loader and a control system therefor in which the position of the interchangeable implements secured to the lift arm assemblies of the loader may be monitored and controlled, without the need to mount sensors or detectors on the implements.

DETAILED DESCRIPTION OF THE PREFERRED EMBODIMENTS

Figure 1:
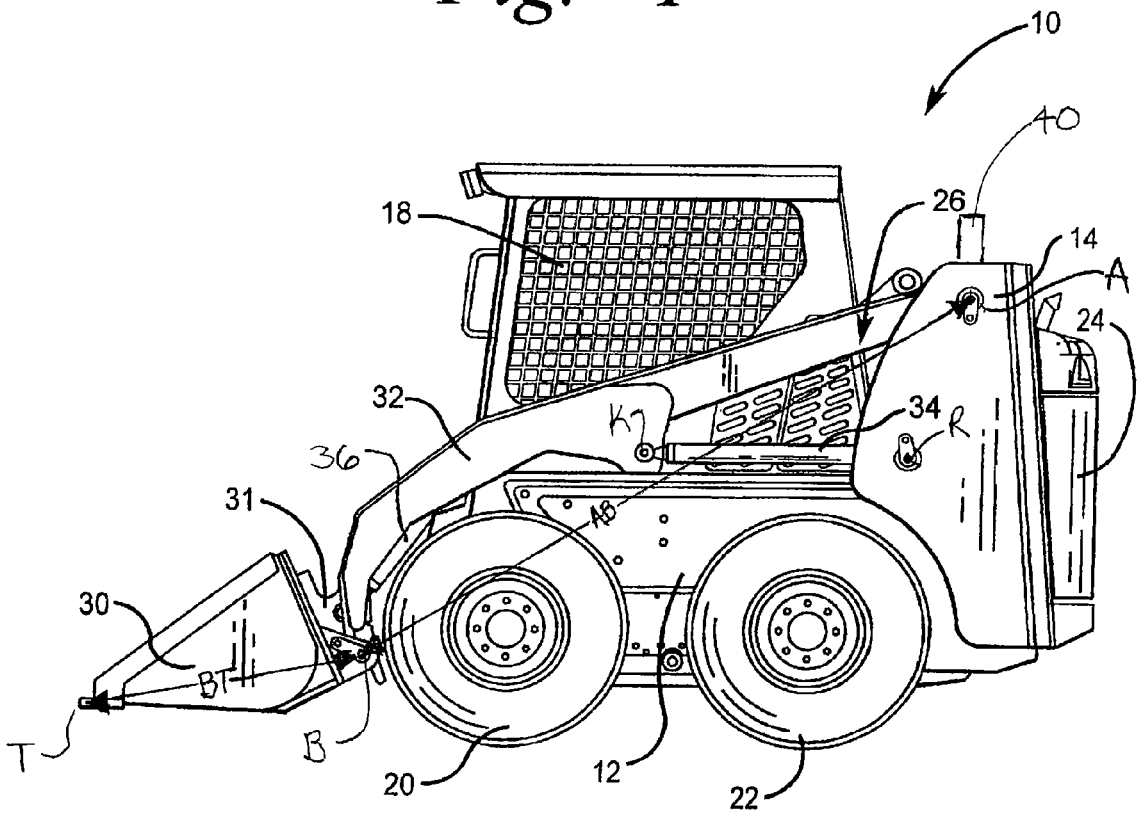
FIG. 1 is a side elevation view of a skid steer loader, constructed in accordance with the present invention, with the lift arms and implement in a lowered position.
Figure 2:
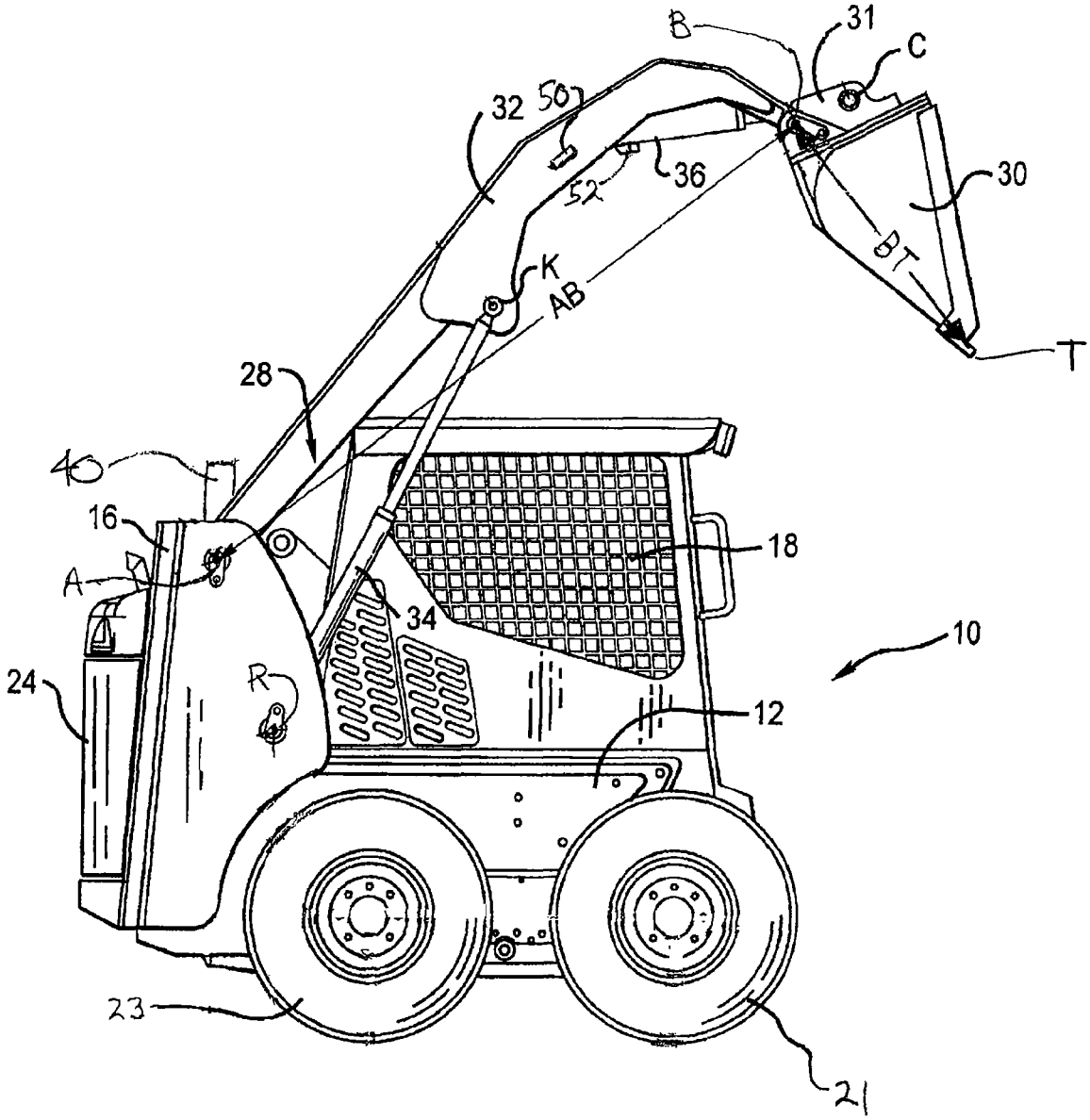
FIG. 2 is a side elevation view, similar to FIG. 1, but showing the loader facing in the opposite direction and with the lift arms and implement in a raised position.

FIG. 1 and FIG. 2 illustrate a loader, more specifically a skid steer loader, constructed according to the present invention. It will be appreciated that although the present invention is shown as a part of a skid steer loader, the invention may also be embodied in a multi-terrain loader of the type that has a pair of endless, driven tracks as the ground engaging drive elements, in place of the wheels that are used in the illustrated skid steer loader. The loader, generally designated 10, comprises a body 12 having left and right upright stanchions or tower portions 14 and 16, respectively, and an operator's station, generally designated 18. The ground engaging drive elements comprise a plurality of driven wheels 20, 21, 22, and 23 that are mounted on, and that support, the body 12. The driven wheels 20-23 are part of a loader drive system that also includes an engine (not shown) which is mounted in the body 12, rearward of the operator's station 18 in a rear engine enclosure 24. The loader may be powered and driven by a diesel engine which drives one or more hydraulic pumps. As will be appreciated, such a loader will have various loader components powered or driven by hydraulic motors and cylinders.

The loader further includes left and right interconnected lift arm assemblies 26 and 28 which are pivotally connected with corresponding tower portions 14 and 16 of the body 12 at pivot points A. The lift arm assemblies 26 and 28 have an implement, such as a bucket 30, pivotally connected with the lift arm assemblies 26 and 28 for movement about an implement pivot axis point B at the forward ends thereof. In the illustrated loader 10, the implement 30 is attached to the lift arm assemblies 26 and 28 by a coupler assembly 31. The coupler assembly 31 itself is pivotally connected with the lift arm assemblies 26, 28. The lift arm assemblies 26, 28 are substantially mirror images of each other, so that the same reference numerals are used for components in both assemblies. Each lift arm assembly 28 comprises a lift arm 32 pivotally connected with the tower portions of the body 12 at lift arm pivot point A. Pivot points A are rearward of the drive wheels 20-23. The lift arm pivot point A and the implement pivot axis point B, in side elevation, define a straight reference line AB.

Each lift arm 32 is pivoted relative to the body 12 to lift the bucket 30 or other implement by means of a lift actuator 34, which typically is a conventional hydraulic cylinder or other linear acting actuator. The lift actuator 34 is connected at one end to the tower portion of the body 12 at a point R located above the rear drive wheels. The lift actuator 34 is connected at its opposite end to the lift arm 32 at a point K.

The bucket 30 may be pivoted relative to the lift arm 32 by means of one or more tilt actuators 36, which are typically hydraulic or other linear acting actuators, connected between the lift arm 32 and the coupler assembly 31, as shown. The tilt actuator 36 is connected at one end to the lift arm 32 and at its opposite end to the coupler 31 at point C. The bucket 30 defines a series of digging teeth T. A straight reference line BT extends from implement pivot axis B to the teeth T.

A position sensor 40 is mounted on the body in fixed relation to the lift arm pivot points A. The position sensor 40 may comprise a GNSS antenna and receiver which, in known manner, determines the three dimensional location coordinates of the antenna and receiver 40.

It should be appreciated, however, that the position sensor can be any of a number of other known position sensing arrangements. The position sensor 40 may, for example, be a total station target. A robotic total station, located at a fixed, known location at a worksite, directs a beam of laser light to the target on the loader, and receives the reflected beam back from the target. By time-of-flight calculations, the distance from the total station to the target is determined. The relative angular position of the target and the distance from the total station to the target then precisely define the position of the target. The total station makes this determination and then transmits the calculated location of the sensor 40 to a receiver on the loader 10.

The position sensor 40 may alternatively comprise a laser receiver, including a vertical row of receiver elements that sense a reference beam of laser light which is swept through a reference plane. This type of position sensor provides only height information. That is, the reference beam of laser light is produced by a laser transmitter that continuously sweeps a beam of laser light through a reference plane. Since the height of the beam is fixed, when the receiver senses the beam, the height of the sensor 40 is then known. However, the X and Y position of the senor 40 will not be determined by the position sensor 40.

In another alternative arrangement, the position sensor 40 may comprise a laser receiver, usually having a single receiver element, which senses a pair of canted fan shaped beams of laser light that are rotated about a generally vertical axis, and swept across the laser receiver. The transmitter that produces these beams of laser light is positioned at a known point at the worksite. The relative times at which the receiver senses the beams provides an indication of the vertical position of the receiver. If the direction of the beams is controlled during their rotation, the heading from the transmitter to the position sensor 40 can also be determined. Alternatively the position sensor 40 may be a receiver for a ground based radio positioning system, which may optionally be combined with a GPS receiver or laser receiver.

Figure 3:
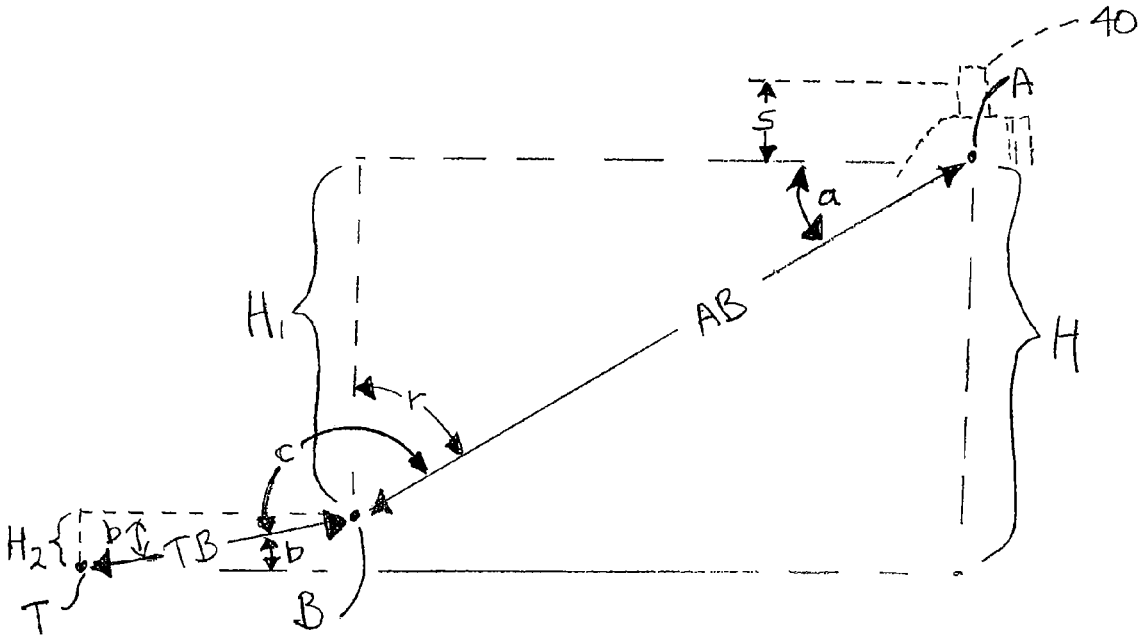
FIG. 3 is a diagram showing relative positions of the parts of the loader.

The vertical position of the position sensor 40 is determined with any of these alternative types of position sensor arrangements. Referring to FIG. 3, it will be seen that this determination is a part of the process of determining the position of the teeth of the bucket 30, or the working portion of any other implement attached to the coupling 31 at the ends of the lift arm assemblies 32. FIG. 3 illustrates the relative positions of the significant points of the loader components. The lift arm pivot point A is a fixed distance S beneath the sensor 40. As will be noted from FIG. 3, the height of the teeth of the bucket T, will be a distance H beneath the pivot point A. The distance H, in turn is equal to $H_1$, the relative position of the pivot point B beneath the pivot point A, plus $H_2$, the relative position of the teeth T beneath the pivot point B. It will be appreciated that the left arm pivot point A will be less than the distance S below the sensor 40 if the loader is significantly tipped forward, to the rear, or to either side. If desired an inclinometer, or a pair of orthogonal inclinometers can quantify this tipping so that appropriate compensation can be made in position calculations. If the sensor 40 and the pivot point A are relatively close, however, any errors in position calculation will be small.

Calculation of $H_1$ and $H_2$ is as follows. The loader 10 includes an inclinometer 50 (FIG. 2) which is mounted on lift arm 32 and which is movable with the left and right interconnected lift arm assemblies to provide an indication of the inclination of the lift arm assemblies along the straight reference line AB. As seen in FIG. 3, this inclination is denoted as angle a. The distance $H_1$ is therefore equal to AB sin(a).

The loader further includes an angle sensor for sensing the angle c, which is the angle between the straight line AB and the straight line BT. This may take the form of an hydraulic cylinder extension sensor 52 which provides an output related to the extension of cylinder 36, which in turn is directly related to the angle c. It will be appreciated that angle c is equal to angle r plus 90° plus angle b. Angle r equals 90°−a.

Therefore, $c=(90°-a)+90°+b$.

And $b=a+c-180°$.

Since $H_2$ equals $TB\sin(b)$, $H_2=TB\sin(a+c-180°)$.

Since $H=H_1+H_2$, $$H=AB\sin(a)+TB\sin(a+c-180°).$$

Therefore, if the height of the sensor 40 is $H_{sensor}$, the height of the teeth of the bucket $H_{teeth}$ is $$H_{teeth}=H_{sensor}-S-AB\sin(a)-TB\sin(a+c-180°).$$

The angle sensor that provides an indication of the orientation of the implement with respect to the left and right interconnected lift arms 32 may, as pointed out above, comprise a sensor that senses the extension of hydraulic cylinder 36. Alternatively, the sensor may comprise an angle sensor that is attached to the forward end of the lift arms 32 and to the implement coupling 31 to provide an indication of the relative angle there between. Alternatively, the angle b may be effectively measured by means of an inclinometer that is mounted to the coupling 31, so that the movement of the inclinometer is associated with the implement.

It will be appreciated that the present invention permits an accurate assessment of the position of a specific portion of implements on a loader where the implements are changed frequently, and where having a sensor affixed to each implement is not practical. A loader of this type may use a wide variety of implements, including cold planers, trenchers, augers, vibratory compactors, blades, box blades and various forks and buckets. With each of these implements, it is useful to monitor the position of a specific working portion. It will be appreciated that it will be necessary to take into account the orientation of the implement on the coupling 31, and the length of a reference straight line, similar to line BT, that runs from the pivot point B to the point of interest on the implement. It will be further appreciated that the length of such a line and its orientation will be different for each implement.

Figure 4:
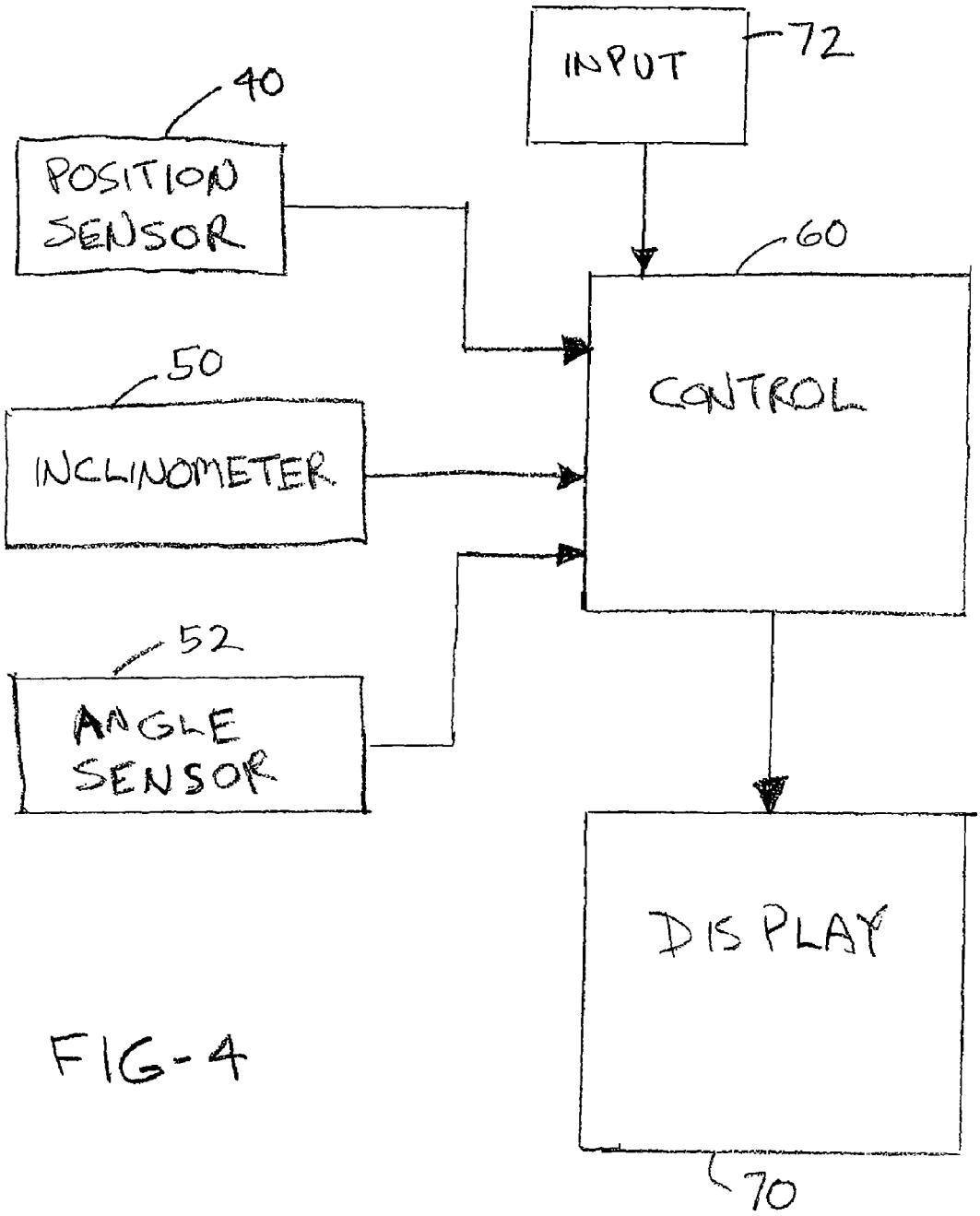
FIG. 4 is a schematic representation of the control system according to the present invention.

FIG. 4 shows the control system of the present invention for a loader. The control system includes a position sensor 40 mounted on the body 12 in fixed relation to the lift arm pivot points A, and an inclinometer 50, movable with the left and right interconnected lift arm assemblies 32 to provide an indication of the inclination of the lift arm assemblies along the straight reference line AB. An angle sensor, such as hydraulic cylinder extension sensor 52, is associated with the implement and the lift arm assemblies 32 for providing an indication of the orientation of the implement with respect to the left and right interconnected lift arm assemblies. The angle sensor may also comprise an inclinometer associated with the implement, as for example being mounted on the coupling 31. The control system further includes a control 60 which is responsive to the position sensor 40, to the inclinometer 50, and to the angle sensor 52, for determining the position of the position sensor 40 and the position of a working part of the implement with respect to the position sensor.

The control system further comprises a display 70 for displaying the position of a part of the implement to the operator of the loader. When the implement being used is a bucket, such as shown in FIGS. 1 and 2, the position of the teeth the bucket is displayed. When the implement being used is other than a bucket, the position of another part of the implement will be displayed. Typically, the part of the implement will be the key operational part of the implement. It will be appreciated that the length of the line TB or similar line from the pivot point B of the loader will vary from one implement to the next, as will the orientation of the reference line to the coupling 31 when the various implements are mounted on the coupling. This data will be stored in control 60. An operator input 72 is provided to permit the operator to input this data, or to identify for the control the specific implement that is mounted on the coupling 31 if the data for this implement has previously been stored in the control 60.

Figure 5:
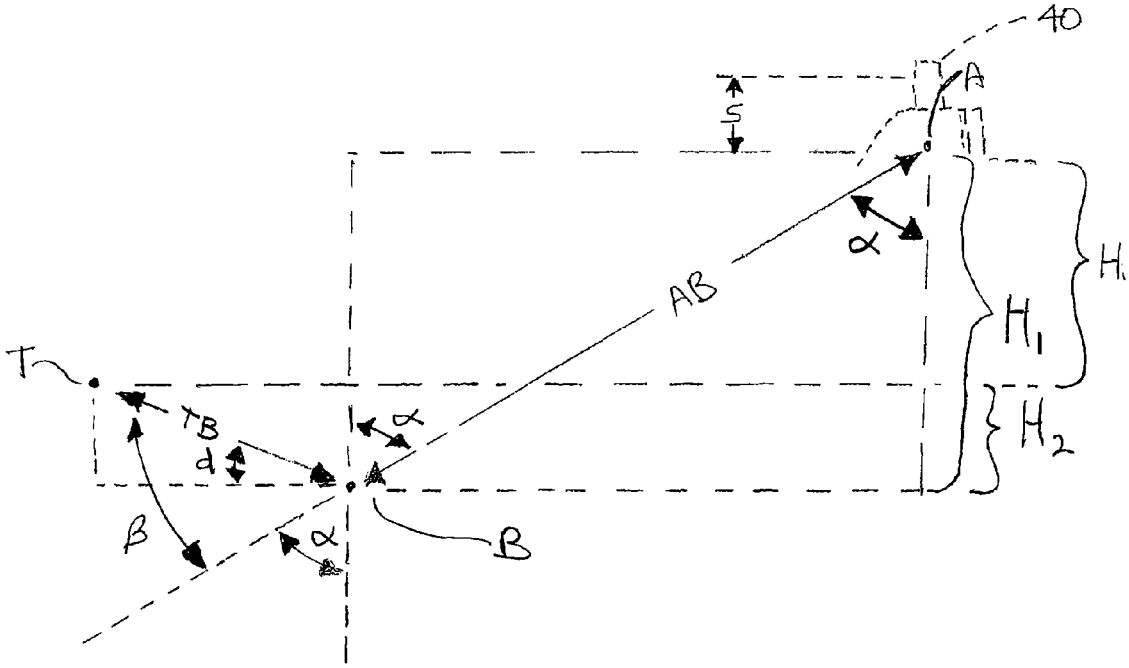
FIG. 5 is a diagram showing the relative positions of the parts of the loader and illustrating alternative angle measurements

Calculation of $H_1$ and $H_2$ may also be effected in the following manner, illustrated in FIG. 5. The loader 10 may include an inclinometer which is mounted on lift arm 32 and which is movable with the left and right interconnected lift arm assemblies to provide an indication of the inclination a of the lift arm straight reference line AB with respect to vertical. The distance $H_1$ is therefore equal to AB cos ($\alpha$).

The loader further includes an angle sensor for sensing the angle $\beta$, which is the angle between an extension of the the straight line AB and the straight line TB. This may take the form of an hydraulic cylinder extension sensor 52 which provides an output related to the extension of cylinder 36, which in turn is directly related to the angle β. It will be appreciated that angle β plus angle α minus 90° is equal to angle d. It will be further appreciated that $H_2$ equals TB sin(d), and therefore that $$H_2=TB\sin(90°-(\alpha+\beta)).$$

Since $H=H_1+H_2$, $$H=AB\cos(\alpha)+TB\sin(90°-(\alpha+\beta)).$$

Therefore, if the height of the sensor 40 is $H_{sensor}$, the height of the teeth of the bucket $H_{teeth}$ is:

$$H_{teeth}=H_{sensor}-S-AB\cos(\alpha)+TB\sin(90°-(\alpha+\beta)).$$

Note that this takes into account the situation in which point T is above or below point B, and point B is above or below point A. It will be appreciated that any of a number of known angle measurement techniques may be used with the present invention to determine angles α and β.

It will be appreciated that the operation of the loader may be automated in those instances in which the key operational part of the implement is to be raised or lowered to specific heights at locations throughout the worksite. For example, if the X, Y, and Z locations of the teeth of the bucket are known, and if the desired Z height of the teeth is known for the measured X and Y location, then the measured Z may be brought into equality with the desired Z by raising or lowering the implement under control of control 60.

Although the presently preferred embodiments of this invention have been described, it will be understood that within the purview of the invention various changes may be made within the scope of the following claims.

The invention claimed is:

1. A loader, comprising:

a body having left and right upright tower portions;

a loader drive system including ground engaging drive elements;

left and right interconnected lift arm assemblies, each assembly having an implement lift arm pivotally connected with a corresponding tower portion of the body at a lift arm pivot point, and a lift actuator connected between the body and the lift arm;

an implement pivotally connected with said lift arm assemblies about an implement pivot axis, said lift arm pivot point and said implement pivot axis in side elevation defining a straight reference line;

at least one implement tilt actuator connected between at least one of said lift arm assemblies and said implement;

a position sensor mounted on said body in fixed relation to said lift arm pivot points;

an inclinometer movable with said left and right interconnected lift arm assemblies to provide an indication of the inclination of said lift arm assemblies along said straight reference line;

an angle sensor for providing an indication of the orientation of said implement with respect to said left and right interconnected lift arm assemblies;

a control, responsive to said position sensor, to said inclinometer, and to said angle sensor, for storing dimensional data regarding the implement and for determining the position of said position sensor and the position of a part of said implement with respect to said position sensor.

2. The loader of claim 1, in which said dimensional data regarding said implement stored in said control includes the distance from said implement pivot axis to said part of said implement, and the orientation of a line from the implement pivot axis to said part of said implement with respect to angle sensor.

3. The loader of claim 2, in which said control stores data for a plurality of different implements that may be connected with said lift arm assemblies.

4. The loader of claim 1, in which said control determines the position of said part of said implement with respect to said position sensor and the desired position of said part of said implement with respect to said position sensor.

5. The loader of claim 1, in which said angle sensor comprises an inclinometer associated with said implement.

6. The loader of claim 1, in which said angle sensor comprises an angle sensor at the pivot connection of said implement to said lift arm assemblies to provide an indication of the relative angle there between.

7. The loader of claim 1, in which said tilt actuator comprises a hydraulic cylinder, and in which said angle sensor comprises an hydraulic cylinder extension sensor.

8. The loader of claim 1, further comprising a display for displaying the position of said part of said implement to the operator of said loader.

9. A control system for a loader of the type having a body, a loader drive system including ground engaging drive elements supporting the body, left and right interconnected lift arm assemblies, each assembly including an implement lift arm pivotally connected with the body at a lift arm pivot point, and a lift actuator connected between the body and the lift arm, an implement pivotally connected with said lift arm assemblies for movement about an implement pivot axis, said lift arm pivot point and said implement pivot axis in side elevation defining a straight reference line, at least one implement tilt actuator connected between at least one of said lift arm assemblies and said implement, said control system comprising:

a position sensor mounted on said body;

an inclinometer movable with said left and right interconnected lift arm assemblies to provide an indication of the inclination of said lift arm assemblies along said straight reference line;

an angle sensor associated with said implement and said lift arm assemblies for providing an indication of the orientation of said implement with respect to said lift arm assemblies; and a control, responsive to said position sensor, to said inclinometer, and to said angle sensor, for storing dimensional data relating to a plurality of implements and for using the data relating to the implement then pivotally connected with said lift arm assemblies for determining the position of a part of said implement with respect to said position sensor.

10. The control system of claim 9, further comprising a display for displaying the position of said part of said implement to the operator of said loader.

11. The control system of claim 10, in which said display also displays the desired position of said part of said implement to the operator of said loader.

12. The control system of claim 9, in which said angle sensor comprises an inclinometer associated with said implement.

13. The control system of claim 9, in which said tilt actuator comprises a hydraulic cylinder, and in which said angle sensor comprises an hydraulic cylinder extension sensor.

14. The control system of claim 9, in which said dimensional data for each of said plurality of implements includes the distance from said implement pivot axis to said part of each of said plurality of implements.

15. The control system of claim 9, in which said position sensor comprises a total station target on the loader, and a receiver on the loader responsive to a total station which tracks the position of said total station target.

16. The control system of claim 9, in which said position sensor comprises a GNSS antenna and receiver.

17. The control system of claim 9, in which said position sensor comprises a laser receiver, responsive to a beam of laser light which is swept through a reference plane.

18. The control system of claim 9, in which said position sensor comprises a laser receiver, responsive to one or more fan shaped beams of laser light which are rotated about a generally vertical axis, and swept across said laser receiver.

* * * * *